United States Patent [19]

Mista

[11] Patent Number: 4,901,931

[45] Date of Patent: Feb. 20, 1990

[54] THREAD SEEKING ARRANGEMENT

[75] Inventor: Kresimir Mista, Heusenstamm, Fed. Rep. of Germany

[73] Assignee: Karl Mayer Textilmaschinenfabrik GmbH, Obertshausen, Fed. Rep. of Germany

[21] Appl. No.: 228,056

[22] Filed: Aug. 4, 1988

[51] Int. Cl.[4] ..... B65H 54/00; B65H 69/04

[52] U.S. Cl. ..... 242/18 R; 242/356 E

[58] Field of Search ..... 242/18 R, 18 AA, 35.6 R, 242/35.6 E, 35.5 R, 35.5 A

[56] References Cited

U.S. PATENT DOCUMENTS

| | | | |
|---|---|---|---|
| 3,236,464 | 1/1963 | Weg | 242/18 R |
| 3,727,852 | 4/1973 | Nelson et al. | 242/35.6 R |
| 4,009,840 | 3/1977 | Muller | 242/35.6 E |
| 4,616,789 | 10/1986 | Matsui et al. | 242/35.5 A X |
| 4,619,416 | 10/1986 | Matsui et al. | 242/35.5 R |
| 4,634,065 | 1/1987 | Kupper et al. | 242/18 R |
| 4,660,370 | 4/1987 | Matsui et al. | 242/35.6 R X |
| 4,735,869 | 4/1988 | Morita | 428/702 |

FOREIGN PATENT DOCUMENTS

| | | | |
|---|---|---|---|
| 411648 | 4/1966 | Switzerland | 242/35.6 E |
| 725990 | 3/1955 | United Kingdom | 242/35.5 A |
| 1450233 | 9/1976 | United Kingdom | 242/35.6 E |

*Primary Examiner*—Stuart S. Levy
*Assistant Examiner*—E. Dunlap
*Attorney, Agent, or Firm*—Omri M. Behr

[57] ABSTRACT

A thread seeking apparatus for handling thread wound on a core of a cop has a cop holding arrangement rotatable about a vertical axis. Also included is an axially symmetrical housing chamber for containing the cop. The housing chamber is sized to have an annular space remaining between the outside of the cop and the inside of the housing chamber. The housing chamber includes a pair of half-shells laterally reciprocatable between an open position and a closed seeking position. The apparatus includes a streaming channel that can receive the thread taken from the circumference of the cop. The streaming channel is positioned to communicate with the upper end of the housing chamber. An inlet jet is mounted at one end of the housing chamber for communicating with the annular space in the housing chamber and causing an airflow therein. Also included is a headpiece connected with the streaming channel and bordering the housing chamber. The headpiece has a bell-shaped mouth for embracing the upper end of the cop. The headpiece is reciprocatable between an engaged and disengaged position while the half-shells are in the closed seeking position.

12 Claims, 2 Drawing Sheets

21
22
33
32
24
15
25
26
14
20
13
16
2
17
10
12
3
11
18
1
8
19
9
23
27
6
28
5
4
31
7
35
38
34
36
37
41
40
39
30
29

THREAD SEEKING ARRANGEMENT

The invention is directed to a thread seeking arrangement comprising a cops holding arrangement which is rotatable about a vertical axis and which further comprises a streaming channel for the reception of the thread end wound circumferentially around the cop.

A thread arrangement of this type is a preparation stage for a spooling machine or the like. This arrangement receives spin cops either directly or indirectly from the spinning machine or alternatively, cops which are returned thereto by reason of their rejection from the spooling machine. The thread end is sought, a predetermined length is pulled off and thereafter attached to the cop in a predetermined manner, either by the formation of a plurality of external circumferential loops or, by insertion into the cop core. The thread end prepared in such a way can be readily grasped in the spooling machine and knotted or spliced with the thread end in the winding spool.

In a known arrangement (DEOS 3630836), the cop holding arrangement carrying the cop, is transported to such a seeking station on a predetermined pathway. At this point, the suction slit of a suction pipe is provided proximate to the rotating outer surface of the cop. The thread end is grasped by the suction stream and pulled into the suction pipe. Then the cop holding arrangement is moved onto a cutting position. There is then provided above the cop, a combined thread testing and cutting arrangement. The suction pipe bent over the cutting point comprises in combination with the suction slit, a longitudinal slit so that the portion of thread taken up in the suction pipe can follow the movement of the cop.

If the testing arrangement determines that no thread end has been taken up, the cop is shifted to a slide path and brought back to the seeking point by activation of a touching arrangement on the upper surface of the cop. An improved result is alleged to be obtained by that seeking arrangement.

The purpose of the invention is to provide a thread seeking arrangement of the above-described type, which does not require the contacting of the outer thread layer, but provides a higher level detection.

SUMMARY OF THE INVENTION

In accordance with the illustrative embodiments demonstrating features and advantages of the present invention, there is provided a thread seeking apparatus for handling thread wound on a core of a cop. The apparatus has a cop holding arrangement rotatable about a vertical axis. The apparatus also has an axially symmetrical housing chamber for containing the cop. This housing chamber is sized to have an annular space remaining between the outside of the cop and the inside of the housing chamber. The housing chamber includes a pair of half-shells laterally reciprocatable between an open position and a closed seeking position. Also included is a streaming channel for receiving the thread taken from the circumference of the cop. This streaming channel is positioned to communicate with the upper end of the housing chamber. The apparatus includes an inlet jet mounted at one end of the housing chamber for communicating with the annular space in the housing chamber and causing an airflow therein. Also included is a headpiece connected with the streaming channel and bordering the housing chamber. The headpiece has a bell-shaped mouth for embracing the upper end of the cop. disengaged position while the half-shells are in the closed seeking position.

By employing such apparatus, a rotationally symmetrical housing chamber is provided for the take-up of the cop during the seeking step. This housing is provided with a circumferential space outside the cop at whose base is provided at least one air stream inlet opening and whose top is connected with a streaming channel.

Thus, the chamber provides an air stream in the internal circumferential space which has axial components impinging on the entire outer surface of the cop. Thus, every circumferential portion of the cop is affected by the air stream during the entire seeking time and not only for a short time while it passes near a suction slit. This situation increases the probability that the thread ends will be carried along with the air stream. The increased probability tends to reduce the search time.

It is advantageous if the inner cross-section of the upper part of the housing is reduced in the upper direction. Thus, the inner cross-section of the housing approximates to that of the cross-section of the form of the cop. This enables the circumferential space to be reduced and hence, one can operate with higher streaming speeds or lower volume of air. Furthermore, there is a ready transition to the upwardly directed streaming channel, so that turbulence zones or the like are substantially avoided. All of this leads to an improvement of the search result and reduces the energy requirement to produce the streaming.

It is further advantageous to provide the housing in the form of two half-shells, which are separable from each other at the seeking position, to provide a release setting. In the release setting, a cop can either be inserted or removed. In the seeking setting, there is provided a closed housing.

BRIEF DESCRIPTION OF THE DRAWINGS

The arrangement is illustrated in the following drawings.

DETAILED DESCRIPTION OF THE DRAWINGS

Figures 1, 2:
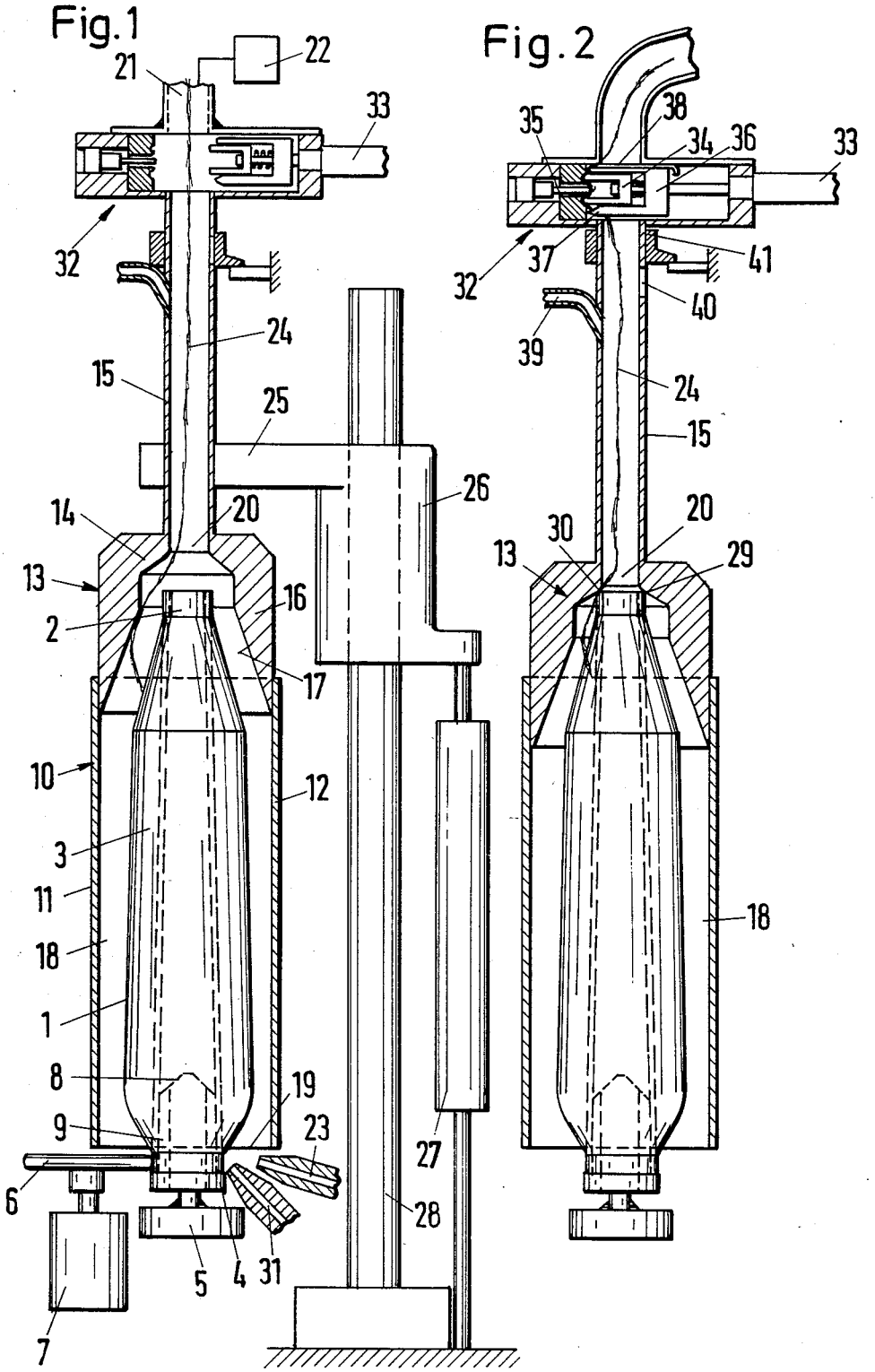
FIG. 1 is an elevational cross-sectional view of the thread seeking arrangement of the present invention in the seeking setting.
FIG. 2 is an elevational cross-sectional view of the arrangement of FIG. 1 in the clamping position.

FIG. 1 shows a cop 1 comprising a core 2 and a thread winding 3, on a cop holding arrangement 4. This arrangement 4 is rotatably mounted on conveyor means 5 and can be caused to rotate by means of friction wheel 6 driven by motor 7. A peg 8 mounted on cop holding arrangement 4 penetrates into core 2. This peg 8 comprises a streaming path 9, for example, a groove or a bore, which connects the underside of the cops holding arrangement with the interior of the core 2. Accordingly, the interior of core 2 is vented below.

In the seeking position, cop 1 is enclosed by rotationally symmetrical housing chamber 10. This chamber 10 comprises two half-cylindrical shells 11 and rotation which has an inverted cup shape with an axial hole and a bell-shaped interior surface. Headpiece 13 comprises a capping wall 14 which is connected to and circumscribes streaming channel 15. Projection 16 of headpiece 13 overlaps the upper portion of cop 1 in a bell-like manner and for this purpose, further comprises inner conical surface 17, so that the inner cross- section of piece 13 is reduced in an upward direction in the same manner as the form of the cops.

It is advantageous to provide housing chamber 10 at its top with a headpiece 13, bordered by the streaming channel, which overcaps the upper cop end in the form of a bell. In using such a headpiece 13, the remaining portion of the cylinder 10 can be readily provided, suitably in the form of two half cylinders.

In this connection, it is desirable that the headpiece 13 can be vertically movable upwardly into a release position independently of the circumferential wall of the housing chamber 13. In the release position, the cop 1 can be inserted or extracted and in the seeking position, the housing chamber 10 is closed.

A circumferential space 18 is provided in the housing chamber, which is open at its lower end 19, which becomes smaller in the region of cone 17 and melds with streaming channel 15 at the connection opening 20. It is important to conduct an airflow through the interspace between cop 1 and housing 10. Various means of causing this air flow are contemplated. It is advantageous to connect the streaming channel with a suction arrangement. Alternatively however, a jet arrangement may be provided at the lower end of the circumferential space and even better result is obtained if it is possible to provide both a suction arrangement as well as a blast arrangement.

At the other end 21 of channel 15 is provided the suction arrangement 22. There is thus provided an axial air stream in circumferential space 18. This air stream grasps the loose thread end 24 and drives it into streaming channel 15.

At the lower end of housing chamber 10, there is provided a blasting arrangement 23 which can be additionally activated to force the air tangentially upwards into annular space 18. Through the combined action of the suction arrangement 22 and the blast arrangement 23, there is provided an air stream whose main components are axial but which further have a tangential component running counter to the rotational direction of the cop holding arrangement 4.

The streaming channel 15 is held firmly in arm 25 of carrier 26 which is movable vertically up and down along a vertical guide means 28 by means of an axial servo motor 27. After a predetermined seeking time, servo motor 27 moves streaming channel 15 and head piece 13 connected thereto, from the seeking position shown in FIG. 1 to the clamping position shown in FIG. 2. In the clamping setting, an annular clamping surface 29 on the side of cap wall 14, which surrounds the connection opening 20, operates in conjunction with the upper edge of cop core 2. Thus, thread end 24 is clamped at clamping point 30 and thus held in place.

Simultaneously, the annular space 18 is separated from streaming channel 15. Under the influence of the suction arrangement 22, however, a stream of air can still pass through the streaming path 9 through the interior of the cop core 2 and streaming channel 15. Thus, the thread end 24 is held under tension.

In streaming channel 15, there is provided a which is activatable by axial servo motor 33. An inner U-shaped bracket 34 operates in conjunction with probe 35 as the thread testing arrangement. A U-shaped outer bracket 36 carries on one side thereof a cutting knife 37 and on the other side, an air closing slider 38 for closing off the streaming channel 15. The actual operation of this device is described co-filed application, (MAY 3.0-109), Ser. No. 07/228,055, whose disclosure is incorporated herein by reference.

It is further advantageous if an air closing slider 38 is provided in the streaming channel distal from the side of the housing chamber having the blast arrangement 23 or air inlet opening. This enables a streaming reversal to take place without the need for turning off the suction arrangement connected to the streaming channel.

As soon as the thread end is clamped as shown in FIG. 2, the servo motor 33 is activated. The probe 35 determines whether thread 24 is present.

In a further embodiment, there are provided means for the reversal of the streaming in the streaming channel 15. In this manner, the thread segment 24 in the streaming channel 15 can be driven into the interior of the cop core 2. This segment can be readily recovered later from this position.

For such a purpose, the streaming channel 15 can be provided with a blasting arrangement 23. Equally, there may be provided a suction arrangement at the lower end of the cop holding arrangement. In this case, the streaming channel is provided with closable air inlet opening. When the blasting arrangement and the air inlet opening are utilized, there is provided an injector effect, which permits the blast stream to be comparatively mild.

By means of cutting knife 37, thread end 24 is cut to the correct length, while the cut-off slider 38 inactivates the effect of suction arrangement 22. Then the blasting arrangement 39 is activated which forces the air in the streaming channel 15 in the opposite direction. By means of the injector effect, further air is drawn through opening 40, which is normally closed by valve ring 41, but which becomes opened by the downward motion of streaming channel 15 in the position shown in FIG. 2. By means of this air stream, thread end 24 is driven into the inside of cop core 2.

In the preferred modification, the covering wall of the housing chamber is provided with an annular clamping surface circumscribing the connecting opening to the streaming channel which, after completion of the seeking step, can cooperate with the face end of the cop core. This clamping surface provides for the holding of the thread end which had been injected into the streaming canal with air jet, for the following work step.

Simultaneously, the clamping surface closes off the circumferential space 18 from connection to the streaming channel 15. Thus, since cop holding arrangement 4 has a streaming opening connecting its outer surface to the inner portion of the cop housing, it is insured that the thread section remaining in the streaming channel, is under tension, which is desirable for the testing and cutting of the thread. This is especially true where a thread testing and/or cutting arrangement is provided in the streaming channel. This circumstance has the further advantage that the testing of the success of the seeking step can occur when the cop is still in the seeking position. Where such a seeking step was unsuccessful, the seeking cycle can be reinitiated without the loss of time.

In place of the foregoing arrangement or in addition thereto, blasting arrangement 31 can be switched into the suction mode.

Figure 3:
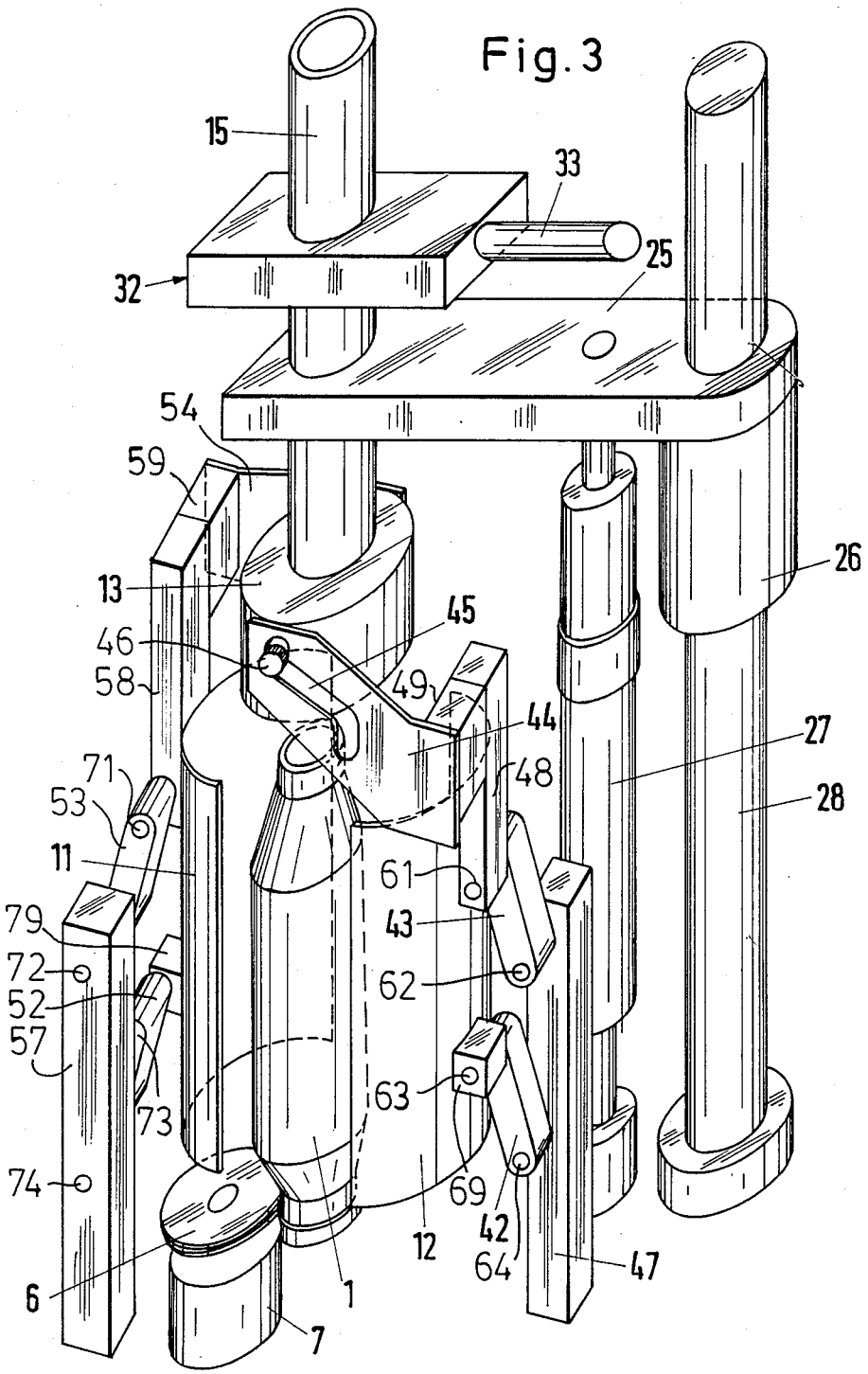
FIG. 3 is a downward perspective view of the arrangement of FIG. 1 in the open position.

Thereafter, the streaming channel 15 together with headpiece 13, are moved into the discharge position shown in FIG. 3 by servo motor 27, whereby the head piece 13 is positioned above cop 1. During this movement both half-shells 11 and 12 of housing chamber 11 are moved sidewards apart from each other.

It is advantageous to provide that the half-shells 11 and 12 and the headpiece 13 are movably coupled with each other and movable by means of a common drive mechanism. For example, the headpiece may be vertically driven, while the half-shells move over cams.

In order to achieve this end, half-shell 12 is connected to fixed beam 47. Blocks 48 and 69 are fixed to the top and lower portions of the outer surface of shell 12. Pins 61 and 63 are horizontally journalled into blocks 48 and 69 and also into the upper ends of levers 43 and 42, respectively, so that said levers can rotate about the axes of said pins. At the other ends of said levers are similarly journalled pins 62 and 64 which are also journalled into fixed beam 47 so that said lower ends of said levers can rotate about the axes of said pins 62 and 64.

The upper end of block 48 is provided with a horizontal extension 49 which is provided with a coupling plate 44, having a slit formed control slot 45, which operates in conjunction with peg 46 on head piece 13.

Similarly, half-shell 11 is connected to fixed beam 57. Blocks 58 and 79 are fixed to the top and lower portions of the outer surface of shell 11. Pins 71 and 73 are horizontally journalled into blocks 58 and 79 and also into the upper ends of levers 53 and 52 respectively so that said levers can rotate about the axes of said pins. At the other ends of said levers are similarly journalled pins 72 and 74 which are also journalled into fixed beam 57 so that said lower ends of said levers can rotate about the axes of said pins 72 and 74. The upper end of block 58 is provided with a horizontal extension 59 which is provided with a coupling plate 54, having a slit formed control slot (not shown) which operates in conjunction with peg (not shown) on the far side of headpiece 13.

The control plates 44 and 54 are so arranged that in lifting head piece 13, the half-shells 11 and 12 are swung so far apart from each other that the cop 1 can be moved on its conveyor 5 out of the seeking position Another cop is then introduced on the other side.

By depression of the head piece 13, the housing chamber 10 is again closed and a new work cycle can be commenced. If the probe 35 finds no thread present, the cop stays in the housing chamber 10 and the seeking process starts again. This can take place several times, if desired, under more and more vigorous working conditions.

For example, in the first stage, only the suction arrangement 22 may be activated, in a second stage the blast arrangement 23 may be brought into play and in the third attempt, an additional jet 31 would be activated.

The aforementioned arrangement is merely to be considered as the preferred embodiment and not limiting of the general idea. For example, the entire housing can be pulled upwardly. It is also possible to provide the cop arrangement in a height settable manner. The three functions of arrangement 32 can also be provided by separate equipment.

What is claimed is:

1. A thread seeking apparatus for handling thread wound on a core of a cop, comprising:

a forwarding means for moving said cop in a vertical orientation;

a cop holding arrangement rotatably mounted on said forwarding means about a vertical axis;

an axially symmetrical housing chamber for containing said cop, said housing chamber being sized to have an annular space remaining between the outside of the cop and the inside of the housing chamber, said housing chamber including a pair of half-shells for encompassing said cop along its length and operable to laterally reciprocate between an open position and a closed seeking position;

a streaming channel for receiving the thread taken from the circumference of the cop, said streaming channel being positioned to communicate with the upper end of said housing chamber;

an inlet jet mounted at one end of said housing chamber for communicating with said annular space in said housing chamber and causing an airflow therein; and a headpiece connected with said streaming channel and bordering said housing chamber, said headpiece having a bell-shaped mouth for embracing the upper end of said cop, said headpiece being reciprocatable between an engaged and disengaged position while said half-shells are in said closed seeking position.

2. A thread seeking apparatus according to claim 1 wherein said mouth of said headpiece is shaped to converge toward said streaming channel, said mouth being spaced from and shaped similarly to the end of the cop facing said mouth.

3. A thread seeking apparatus according to claim 2 further comprising:

a shell motor coupled to said pair of half-shells for alternately moving them together and apart.

4. A thread seeking apparatus according to claim 3 comprising:

a pair of brackets separately connected to said pair of half-shells and each having an inclined surface coupled to said headpiece for reciprocating said half-shells as said headpiece reciprocates, said headpiece being operable to move into said housing chamber after its half-shells reach said closed seeking position.

5. A thread seeking apparatus according to claim 4 wherein said headpiece and streaming channel are affixed together to reciprocate in unison, said streaming channel having a venting aperture, said valve being stationary and slidably secured to the outside of said streaming tube to slide across said aperture as said headpiece reciprocates.

6. A thread seeking apparatus according to claim 2 wherein said headpiece has a thread clamping surface in its mouth adjacent said streaming channel for engaging the end of said core as said headpiece reciprocates.

7. A thread seeking apparatus according to claim 6 wherein said cop holding arrangement is vented to allow airflow through said core.

8. A thread seeking apparatus according to claim 1 comprising:

preparation means located in said streaming channel for detecting the presence of said thread and cutting it.

9. A thread seeking apparatus according to claim 8 comprising:

reversing means for reversing the direction of airflow in said streaming channel.

10. A thread seeking apparatus according to claim 9 wherein said reversing means comprises:

a reversing jet communicating with said streaming channel for streaming air from it into the core of said cop.

11. A thread seeking apparatus according to claim 10 further comprising:

a valve mounted on said streaming channel for venting it.

12. A thread seeking apparatus for handling thread wound on a core of a cop, comprising:

a cop holding arrangement rotatable about a vertical axis;

an axially symmetrical housing chamber for containing said cop, said housing chamber being sized to have an annular space remaining between the outside of the cop and the inside of the housing chamber, said housing chamber including a pair of half-shells laterally reciprocatable between an open position and a closed seeking position;

a streaming channel for receiving the thread taken from the circumference of the cop, said streaming channel being positioned to communicate with the upper end of said housing chamber;

an inlet jet mounted at one end of said housing chamber for communicating with said annular space in said housing chamber and causing an airflow therein;

a headpiece connected with said streaming channel and bordering said housing chamber, said headpiece having a bell-shaped mouth for embracing the upper end of said cop, said headpiece being reciprocatable between an engaged and disengaged position while said half-shells are in said closed seeking position;

preparation means located in said streaming channel for detecting the presence of said thread and cutting it;

reversing means for reversing the direction of airflow in said streaming channel, said reversing means comprising a reversing jet communicating with said streaming channel for streaming air from it into the core of said cop;

a valve mounted on said streaming channel for venting it; and an air cut-off slider mounted in said streaming channel distal to said housing chamber, said reversing jet and said valve being mounted between said housing chamber and said air cut-off slider.

* * * * *